US006059535A

United States Patent [19]

Wichmann et al.

[11] Patent Number: 6,059,535

[45] Date of Patent: May 9, 2000

[54] PUMP WITH AIR PURGING AND SELF-CLEANING FEATURES

[75] Inventors: John M. Wichmann, Commerce Township; Kurt M. McCourt, Farmington Hills, both of Mich.

[73] Assignee: Process Systems, Inc., Warren, Mich.

[21] Appl. No.: 09/012,101

[22] Filed: Jan. 22, 1998

[51] Int. Cl.[7] ..... F04B 49/00; F03B 11/04

[52] U.S. Cl. ..... 417/36; 417/53; 415/56.1

[58] Field of Search ..... 417/53, 36, 40, 417/360; 415/56.1, 56.3

[56] References Cited

U.S. PATENT DOCUMENTS 4,936,759 6/1990 Clausen et al. ..... 417/423.14
5,160,459 11/1992 Guarnaschelli et al. ..... 261/92
5,509,779 4/1996 Mori et al. ..... 415/56.1
5,676,520 10/1997 Thut ..... 415/121.3
5,842,832 12/1998 Thut ..... 417/53

*Primary Examiner*—Thomas N. Moulis
*Assistant Examiner*—Mahmoud M. Gimie
*Attorney, Agent, or Firm*—John R. Benefiel

[57] ABSTRACT

A pump installation used to maintain liquid level in a tank by pumping down liquid introduced into the tank with rotation of an impeller about a vertical axis features an air purging flow defined by axial openings through the pump impeller and an annular clearance space between the impeller drive and the pump housing cover, the space disposed above the impeller axial openings. A support sleeve surrounding the impeller drive and secured to the pump motor and tank top has openings at the bottom thereof which sets up a flushing liquid flow to eliminate solids forced up through the clearance space and into the sleeve interior.

6 Claims, 1 Drawing Sheet

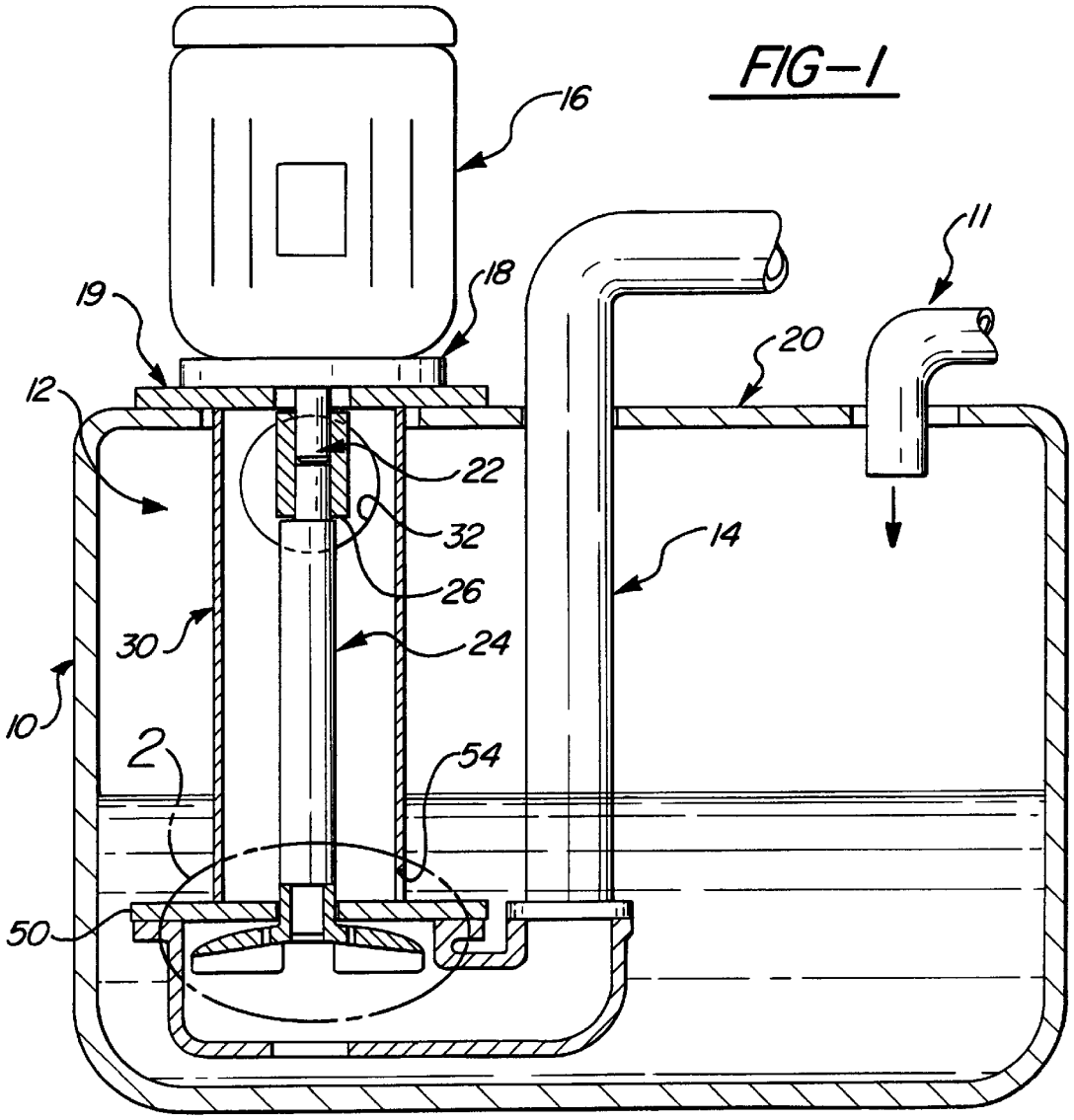
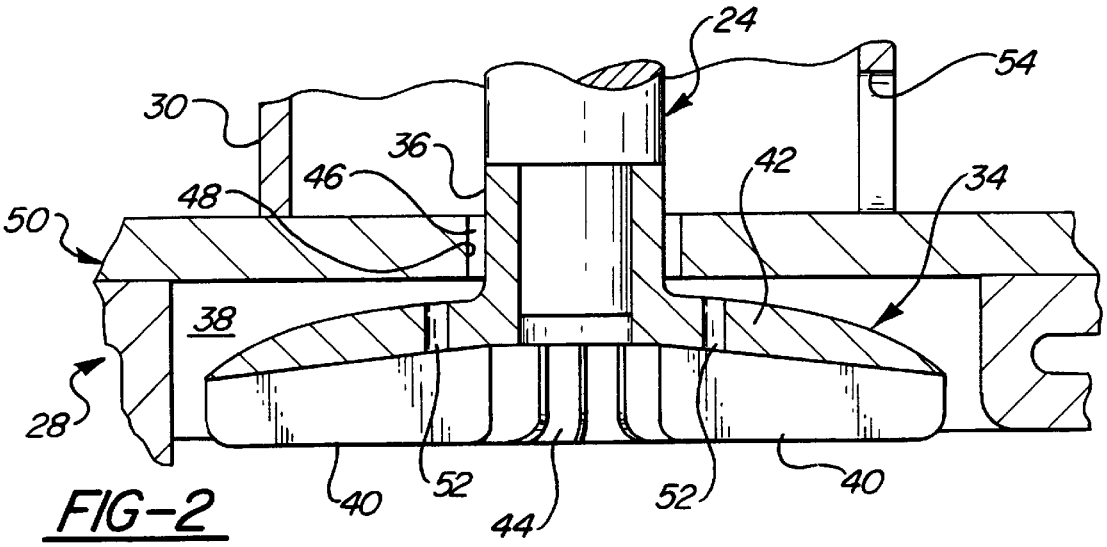
FIG-2

PUMP WITH AIR PURGING AND SELF-CLEANING FEATURES

BACKGROUND OF THE INVENTION

This invention concerns pumps and pump installations in which a liquid level in a tank is repetitively pumped down to a predetermined level by a pump impeller submerged in the liquid. In some installations, the pump is run continuously until the liquid declines to a level where air is introduced into the pump impeller and pumping ceases. As liquid continues to flow into the tank and the level rises to cover the impeller, the pump will again begin pumping liquid but only after a predetermined delay caused by the need for the pump to eliminate air, which can accumulate at the "eye" of the impeller. The liquid is typically highly aerated increasing the tendency to form an air bubble. The impeller will eventually cause the air to be pumped out of the discharge, but this process takes some time such that the liquid level may rise well above the level to be maintained due to the delay in reestablishing prime.

This effect necessitates a greater tank and pump capacity to insure that an overflow condition is not reached and also results in greater fluctuation in the liquid levels in the tank.

In one prior design, the pump is driven by a motor supported above the liquid, the pump volute supported on a sleeve fixed to the motor support and surrounding an extension of the motor shaft driving the pump impeller.

The extension impeller drive shaft is supported at the upper end by the motor shaft or by separate bearing housing, so as to eliminate the need for a sealed submerged shaft bearing. A substantial clearance space is provided between a wall opening through which the impeller drive shaft passes to avoid the need for a bearing.

Such pump installations are often used in handling machine tool coolant containing metal cuttings and abrasive grit. These solids tend to be forced up into the support sleeve through the extension shaft clearance, and can accumulate to a point where the pump must be disassembled to clean out the accumulated solids in the support sleeve interior. Some installations do have sleeve openings located at intermediate heights on the sleeve and still allow accumulation of solids around the shaft and within the lower end of the sleeve.

It is an object of the present invention to provide an impeller design for such pump installations which will rapidly purge air from the impeller such as to quickly begin pumping liquid when the impeller becomes submerged in liquid.

It is another object of the present invention to provide an improvement for such pump installations which will purge the sleeve interior of solids forced up into the sleeve to eliminate the need for periodic disassembly for cleaning.

SUMMARY OF THE INVENTION

These and other objects of the present invention, which will become apparent upon a reading of the following specification and claims, are achieved by forming axial through openings through the impeller disc in the vicinity of the annular clearance space around the impeller drive shaft. This arrangement establishes a flow path allowing captured air to be rapidly purged by flowing upwardly through the impeller disc openings and out through the annular clearance space almost immediately as soon as the liquid level rises to submerge the impeller.

The surrounding sleeve is also formed with purge flow opening(s) at its base. These openings allow liquid and any solids passing up into the sleeve through the shaft clearance to be continuously flushed back out into the tank.

DESCRIPTION OF THE DRAWINGS

FIG. 1 is a partially sectional view of a pump installation and a tank into which liquid is introduced to be pumped out by operation of a pump included in the installation.

FIG. 2 is an enlarged fragmentary view of the portions of the pump installation within the circle 2 of FIG. 1.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, a tank 10 is depicted into which liquid is continuously (or periodically) introduced through an inlet pipe 11. The liquid accumulating in the tank 10 is pumped out by a pump installation 12 installed in the tank 10, exiting through an outlet pipe 14.

The pump installation 12 includes an electric motor 16 secured to a mounting plate/cover plate 19 overlying an opening in the tank top 20. A motor shaft 22 is connected to an impeller drive extension 24 with a coupling 26.

A pump housing 28 is held in the tank 10 by a support sleeve 30 within which are enclosed a motor shaft 22 and a vertical impeller drive extension 24. The upper part of the support sleeve 30 has an access hole 32.

An impeller 34 is attached to the lower end of the extension 24, received in an impeller forming a part of the means for driving the impeller 34. The impeller 34 is recessed into a volute portion 38 of the housing 28. The impeller 34 has conventional vanes 40 projecting axially out from an impeller disc 42, spiraling out from an "eye" region 44 at the center of the impeller 34.

A series of through holes 52 extend axially through the impeller disc 42, here shown as arranged circumferentially around the impeller center in the vicinity of the eye region 42. These holes could be provided in other locations and in other hole patterns.

A substantial annular clearance space 46 is provided between the impeller hub 36 (or shaft) and the inside of a clearance bore 48 in an end plate 50 mounted over the top of the pump housing 28 and welded to the bottom of the support sleeve 30.

The axial through holes 52 and clearance space 46 provide a fluid flow path allowing rapid elimination of the air bubble under the impeller 34 such that priming takes place very quickly. The pumping of liquid thus resumes almost immediately when liquid rises in the tank to immerse the impeller 34.

Some slight liquid flow diversion also occurs through this same flow path. In order to flush solids otherwise accumulating within the sleeve 30, opening(s) 54 is/are provided at the base of the sleeve 30, lying flush or even with the end plate 50 so that liquid can flow radially out from the space 46 across the plate 50 through the opening 54. Thus, the liquid flow will carry away any solids back into the tank liquid and preventing their accumulation around the shaft 36.

Keeping the inside of the sleeve 30 clear particularly around the tube or shaft 36 also allows air to be eliminated more quickly when self priming is carried out. Thus, after prime is lost by pumping the level in the tank 10 below the top of the pump housing 28, prime is quickly reestablished since the air trapped beneath the impeller 34 is rapidly eliminated. The purging features do not add appreciably to the cost or complexity of the installation, but enable a rapid priming action to occur. This in turn minimizes the need for reserve tank and pump capacity as the liquid level can be maintained closer to the desired level.

Further, the need for regular clean out of the support sleeve 34 is minimized or eliminated altogether.

It should be noted that while application to a "close coupled" installation has been shown in which the motor shaft bearing supports the extension, the concept is also applicable to frame mounted designs in which a separate bearing assembly is provided between the motor and shaft.

What is claimed is:

1. A liquid collection system including a tank for receiving a liquid, and a pump installation including a pump motor having an output shaft extending vertically down from a top of said tank, an impeller drive means drivingly connected to said motor shaft, a fixed support sleeve extending down over said impeller drive means, a pump housing supported at a bottom end of said sleeve, an impeller mounted in said pump housing and drivingly connected to said impeller drive means to be rotatable about a vertical axis, said impeller including an impeller disc, and a series of radially outwardly extending vanes projecting axially downward from one side of said disc, a cover plate overlying said pump housing and having a bore therein receiving a segment of said impeller drive means with a substantial annular clearance between, at least one opening extending axially through said impeller disc in a radially inward location to allow air trapped beneath said impeller disc to flow upwardly through said opening, and through said annular clearance, whereby said pump is able to rapidly eliminate air beneath said impeller disc to quickly re-achieve prime after losing prime by pumping down liquid in said tank.

2. The liquid collection system according to claim 1 wherein a plurality of axially extending openings through said impeller are arranged around said impeller axis.

3. The liquid collection system according to claim 1 wherein said bottom end of said sleeve is welded onto said cover plate, and further including opening(s) in said support sleeve at the bottom thereof, opening(s) even with said cover plate to allow a purging flow of liquid out of the interior of said support sleeve and onto said plate, flushing out any solids entering said support sleeve interior.

4. A method of repriming a liquid pump including an impeller rotated about a vertical axis within a volute housing by a drive means extending through a bore in a cover over said volute housing, comprising the steps of:

forming an axial opening through said impeller establishing a clearance space between said impeller drive and said bore in said volute cover above the opening in said impeller, to thereby rapidly eliminate air trapped beneath said impeller by flow through said impeller opening and out through said clearance space.

5. The method according to claim 4 wherein said pump housing and volute cover are supported by a vertical support sleeve connected to said cover, and further including the step of forming an opening at the bottom of said sleeve to allow a flushing flow of liquid passing through said clearance space and out through said sleeve opening.

6. A liquid collection system including a tank for receiving a liquid, and a pump installation for pumping liquid out of said tank, said pump installation including a pump motor having an output shaft extending vertically down into said tank, an impeller drive means drivingly connected to said motor shaft, a fixed support sleeve extending down over said impeller drive means, a pump housing supported at a bottom end of said sleeve, an impeller mounted in said pump housing and drivingly connected to said impeller drive means to be rotatable about a vertical axis, a cover plate overlying said pump housing and having a bore therein receiving a segment of said impeller drive means with a substantial annular clearance therebetween;

wherein said bottom end of said sleeve is welded onto said cover plate and further including an opening in said support sleeve at the bottom thereof, opening even with said cover plate to allow a purging flow of liquid out of the interior of said support sleeve and onto said plate, flushing out any solids entering said support sleeve interior.

* * * * *

UNITED STATES PATENT AND TRADEMARK OFFICE

CERTIFICATE OF CORRECTION

PATENT NO. : 6,059,535

DATED : May 9, 2000

INVENTOR(S) : John M. Wichmann, et al

It is certified that error appears in the above-identified patent and that said Letters Patent is hereby corrected as shown below:

Column 1, line 14, delete "can" and insert ---- tends to ----
Column 1, line 18, delete "discharge" and insert ---- outlet ----
Column 1, line 67, delete "opening(s)" and insert ---- opening ----
Column 1, line 67, delete "." and insert ---- , liquid pumped into the sleve causing ----
Column 2, line 26, delete "plate/cover plate" and insert ---- plate 18 affixed to a cover plate ----
Column 2, line 37, after "conventional" insert ---- curved ---
Column 2, line 59, delete "opening(s) 54 is/are" and insert --- opening 54 is ----
Column 4, line 1, delete "opening(s)" and insert ---- an opening ----
Column 4, line 2, delete "opening(s)" and insert ---- opening ----
Column 4, line 25, after "down" delete "into" and insert ---- from a top of ----.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*